US005673629A

United States Patent [19]

Ginnow

[11] Patent Number: 5,673,629

[45] Date of Patent: Oct. 7, 1997

[54] END CAP CONSTRUCTION FOR WOODEN PALLETS

[75] Inventor: Roger Ginnow, Bethany, Conn.

[73] Assignee: Rex Development Corporation, Bethany, Conn.

[21] Appl. No.: 571,079

[22] Filed: Dec. 12, 1995

[51] Int. Cl.[6] ..... B65D 15/00

[52] U.S. Cl. ..... 108/51.1; 108/56.1

[58] Field of Search ..... 108/51.1, 56.1, 108/56.3, 27; 403/11, 23, 232.1; 52/301, 177

[56] References Cited

U.S. PATENT DOCUMENTS

| | | | |
|---|---|---|---|
| 2,710,996 | 6/1955 | Pittman | 52/301 |
| 2,794,611 | 6/1957 | Sjoblom et al. | 108/51.1 |
| 4,142,471 | 3/1979 | Mustoe et al. | 108/51.1 X |
| 4,292,899 | 10/1981 | Steffen | 108/51.1 |
| 4,715,294 | 12/1987 | Depew | 108/51.1 |
| 5,076,175 | 12/1991 | Whatley, II | 108/51.1 |
| 5,487,343 | 1/1996 | Phillips | 108/56.1 X |

FOREIGN PATENT DOCUMENTS

| | | | |
|---|---|---|---|
| 131602 | 5/1951 | Sweden | 108/51.1 |

*Primary Examiner*—Peter M. Cuomo
*Assistant Examiner*—Janet M. Wilkens
*Attorney, Agent, or Firm*—Melvin I. Stoltz

[57] ABSTRACT

A highly effective, easily installed, stringer end capping/protecting system is achieved wherein each terminating end of each stringer is quickly and easily protected from breakage, destruction, or damage by affixing a damage controlling reinforcing plate to the terminating ends of each stringer. Preferably, the damage controlling reinforcing plate is securely affixed to the terminating ends of the stringer by a generally bracket member which peripherally surrounds the reinforcing plate and extends therefrom for affixation to the sides of the stringer. In this way, the bracket member envelopes the terminating ends of each stringer and securely affixes the reinforcing plate thereto by sandwiched interengagement of the reinforcing plate between the end of the stringer and an intermediate portion of the bracket. By securely mounting a reinforcing plate member to each terminating end of each stringer, the stringer is protected from damage due to contact by the tines of a forklift truck. As a result, damage is virtually eliminated and a substantially trouble-free, pallet construction is achieved.

16 Claims, 4 Drawing Sheets

END CAP CONSTRUCTION FOR WOODEN PALLETS

TECHNICAL FIELD

This invention relates to wooden pallets, and more particularly, to a protector cap construction mountable to the terminating ends of each pallet stringer to prevent damage thereto.

BACKGROUND ART

Many industries and businesses now employ pallets for storing and handling a wide variety of products, with forklift trucks being employed to move the pallets between various locations, whenever required. Because of the relative each and convenience that is provided by pallets as a storage medium, the acceptance and use of pallets for this purpose has enjoyed an ever-increasing demand. In addition, although various materials have been employed for constructing pallets, pallets constructed from wood are the most common and dominant product in most industries and businesses.

Generally, a conventional wooden pallet is constructed by employing a plurality, usually three, elongated wood joists or stringers arranged in juxtaposed, spaced, parallel relationship with each other, in combination with a plurality of wood plank members positioned in juxtaposed, spaced, parallel relationship with each other and arranged perpendicularly to the longitudinal extending stringers. The plank members are fastened to the top edge and bottom edge of each stringer. In this way, a unitary, generally rectangular shaped platform is created on which any desired product can be positioned for storage.

In order to enable the pallets to be easily moved from one location to another, whenever desired by the user, most entities employ forklift trucks which are self-propelled vehicles incorporating a lifting platform or mechanism which extends outwardly from the truck body in a generally horizontal position and can be moved vertically into a variety of alternate heights. Typically, the horizontally mechanism comprises two elongated juxtaposed, spaced, parallel "fork" tines extending forwardly from the forklift truck. The tines are constructed for being raised or lowered vertically to any height within the range of the vertical support mechanism.

In order to enable the pallets to be easily moved to any location by employing the horizontally extending tines of the forklift truck, the stringers of each pallet are universally constructed with a spacing that allows the two tines to nest in cooperating interengagement between the three stringers of the pallet. In this way, by inserting the two tines between the three stringers, interengagement of the pallet with the tines of the forklift truck is easily achieved and the pallet along with the products stored thereon can be raised to a suitable height and transported to any other desired location. Once in a desired location, the tines are lowered, the pallet is placed in its new position, and the tines of the forklift are withdrawn therefrom.

In order to further accommodate the movement of the pallet by the forklift truck, many pallets are constructed with cutout zones formed along the bottom edge of each of the stringers, with the two cutout zones being spaced apart a distance equal to the spaced distance of the tines of a conventional forklift truck. In this way, the forklift truck is able to lift such pallets by engaging the pallet either between the stringers, or by engaging the pallet perpendicularly to the stringers by placement of the tines through the cutout zones formed in each of the pallets.

Although these systems have become a standard in many industries and have received substantial commercial success and broad use and applicability, the conventional pallet construction suffers from many problems caused during typical use. Although breakage of the interconnecting planks frequently occurs, such boards are usually easy to be repaired or replaced. However, another common problem typically encountered with wooden pallets is the breakage of the stringer itself due to contact with the leading edge of the tine of the forklift truck. In these instances, repair is often impossible and the only recourse is to have the broken stringer replaced or the entire wooden pallet scrapped.

In its typical construction, stringers are formed from a hard wood in order to provide the desired longevity for the pallet construction. As a result, the stringers represent the most costly part of the pallet and, therefore, the most costly element to replace.

During use, forklift operators often misjudge the location of the tines, as the tines are being engaged with the pallet, causing the tines to contact the terminating ends of the stringers. This contact often results in damage, breakage, or fracture of the stringer at its terminating end. In addition, stringers are also frequently damaged by contact with the tines of a forklift truck which is caused by the forklift operator cornering around the pallet at a sharper angle than intended, causing the leading edge of the tine to crash into the terminating end of the stringer. This type of contact usually results in fracture or breakage of a substantial portion of a stringer end.

Since the inherent rigidity and strength of the pallet is based upon the structural integrity of the stringer, any damage or breakage of the stringer by the tines of the forklift truck often results in a pallet construction which cannot be used effectively. Consequently, either repair or scrapping of the entire pallet is required. Furthermore, although damage to the stringer most often occurs only at the terminating ends of the stringer, no construction or system has been developed which effectively prevents or substantially reduces damages to stringers at this location.

Although various prior art systems have been developed in an attempt to address this problem, such prior art systems have only produced metal reinforcing panels affixed to the side edge of the outwardmost stringers to protect the stringers from damage during use along its length. However, no prior art system has been developed which in any way reduces or prevents damage to the terminating ends of the stringers in a conventional pallet construction.

Therefore, it is a principal object of the present invention to provide a system which is mountable to the terminating ends of each stringer and provide protection thereto from unwanted contact with the tines of a forklift truck.

Another object of the present invention is to provide an end protection system for stringers having the characteristic features described above which effectively covers or caps each stringer end with a reinforcing member which prevents damage thereto.

Another object of the present invention is to provide a stringer end protecting/capping system which is inexpensive to produce and easy to install.

Another object of the present invention is to provide a stringer end protecting/capping system which also protects the plank members positioned above and below the stringer.

Other and more specific objects will in part be obvious and will in part appear hereinafter.

SUMMARY OF THE INVENTION

By employing the present invention, all of the prior art difficulties and drawbacks are eliminated and a highly effective, easily installed, stringer end capping/protecting system is achieved. In the present invention, each terminating end of each stringer is quickly and easily protected from breakage, destruction, or damage by affixing a damage controlling reinforcing plate to the terminating ends of each stringer.

In the preferred embodiment, the damage controlling reinforcing plate is securely affixed to the terminating ends of the stringer by a generally U-shaped bracket member which peripherally surrounds the reinforcing plate and extends therefrom for affixation to the sides of the stringer. In this way, the bracket member envelopes the terminating ends of each stringer and securely affixes the reinforcing plate thereto by sandwiched interengagement of the reinforcing plate between the end of the stringer and an intermediate portion of the bracket By employing the present invention, it has been found that the reinforcing plate member mounted at the terminating ends of the stringer prevents any damage from being caused to the stringer whenever contact between the stringer and the tines of a forklift truck occurs. As a result, damage is virtually eliminated and substantially trouble-free, damage-free pallet construction is achieved.

In the preferred embodiment, the reinforcing plate of the present invention is formed from metal, which is strong, durable, and resistant to easy bending or deformation. It has been found that metals such as rolled steel, stainless steel, and hardened steel can be effectively employed as the reinforcing plate of the present invention.

In addition, the size of the reinforcing plate can be varied depending upon the overall effect desired. In one embodiment of the present invention, the reinforcing plate comprises a height and width substantially equivalent to the height and width of the terminating end portion of the stringer over which the reinforcing plate is mounted. In this way, the reinforcing plate substantially covers the stringer end in its entirety.

In an alternate embodiment, the reinforcing plate of the present invention comprises a width consistent with the width of the stringer end, while having a height which extends beyond the height of the stringer end at both the top and bottom, so as to overlie both the top and bottom plank member in the area in which the plank member is affixed to the stringer. In this embodiment, the reinforcing plate protects the stringer end, while also protecting a portion of each plank member affixed to each stringer at both the top and bottom. In a third alternate embodiment, the reinforcing plate comprises a width substantially equivalent to the width of the stringer end while having a length which extends either upwardly or downwardly to cover one plank member, as opposed to both plank members.

In order to attain a stringer end capping/protecting system which is easily securely mounted to the stringers of any pallet, the U-shaped bracket member is preferably formed from a flexible sheet material which can be easily wrapped about the end of the stringer with the reinforcing plate sandwiched between the bracket and the stringer end. Once in position, the sides of the U-shaped bracket can be quickly and easily affixed to the sides of the stringer by simply driving nails through the sides of the bracket to affix the bracket to the wooden stringer. In this way, the stringer end cap/protecting system of the present invention is quickly and easily secured to any existing pallet construction as well as any new pallet construction in order to impart the enhanced benefits thereto.

The invention accordingly comprises an article of manufacture possessing the features, properties and relation of elements which will be exemplified in the article hereinafter described and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

By referring to FIGS. 1–11, along with the following detailed disclosure, the construction and operation of the preferred embodiment of the present invention can best be understood. Although several alternate embodiments are disclosed herein, further alternate embodiments can be constructed without departing from the scope of the present invention. Consequently, it is intended that the embodiments discussed herein are merely exemplary of the present invention and are not intended as a limitation of the scope of this invention.

Figures 1, 2:
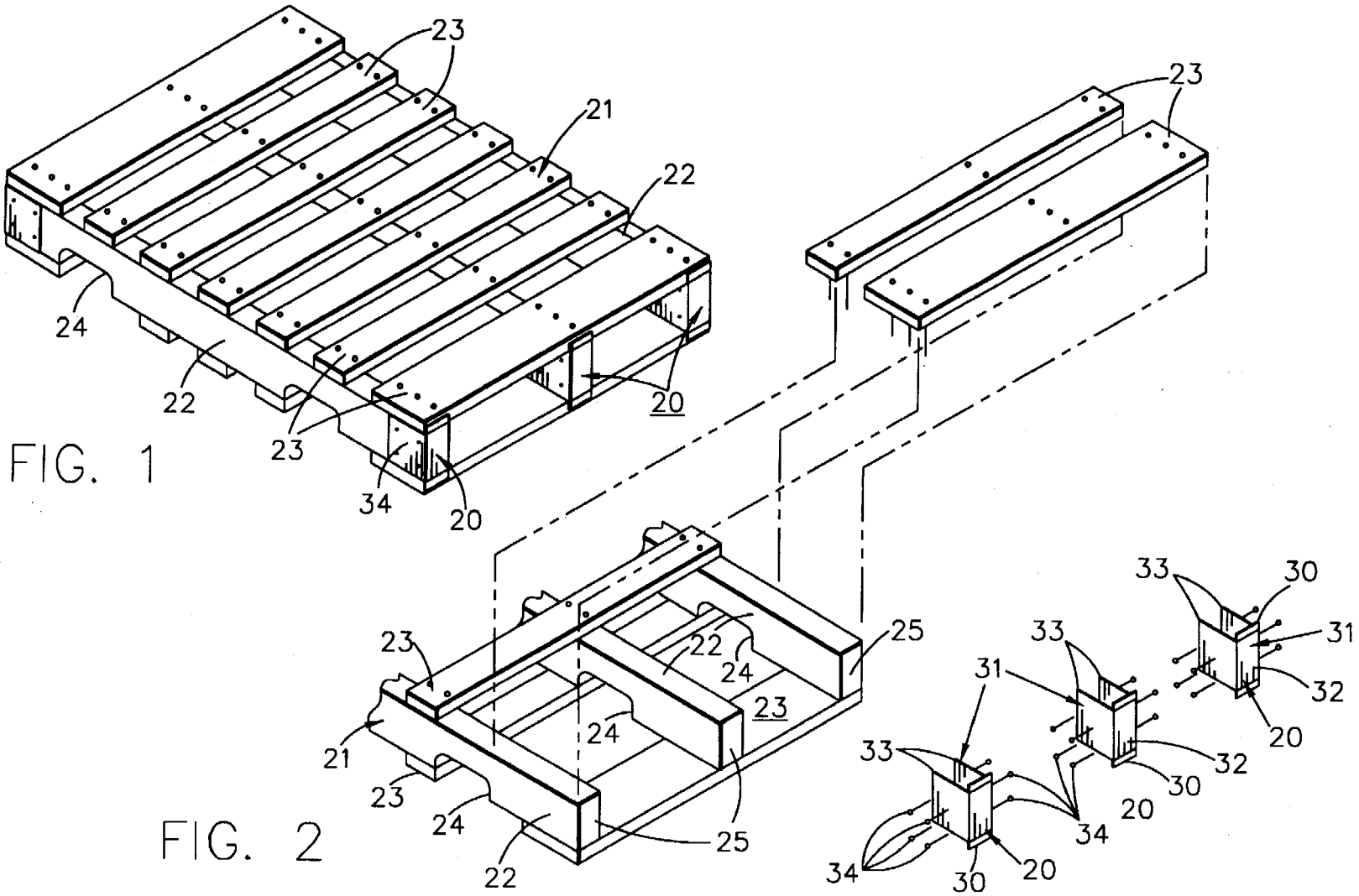
FIG. 1 is a perspective view of a wooden pallet to which the stringer end capping/protecting system of the present invention has been mounted.
FIG. 2 is an exploded perspective view, partially broken away, of the wooden pallet and stringer end capping/protecting system of FIG. 1.

In FIGS. 1 and 2, a plurality of stringer end capping/protecting systems 20 are depicted securely affixed to pallet 21, as well as depicted prior to assembly to pallet 21. Pallet 21 comprises a general conventional construction, formed by three elongated stringers 22, positioned in juxtaposed, spaced, parallel relationship to each other, with stringers 22 interconnected by a plurality of plank members 23 extending perpendicularly to stringers 22 and affixed to both the top edge and bottom edge of each stringer 22.

In the pallet embodiment depicted in FIGS. 1 and 2, stringers 22 each incorporate two cutout zones 24 formed there along the bottom edge of each stringer 22 and positioned in juxtaposed, spaced relationship to each other.

Cutout zones 24 are constructed to enable the tines of a forklift truck to be inserted therein, in order to allow pallet 21 to be raised and lowered. In addition, as discussed above, the tines of a conventional forklift truck are also insertable into the two open zones formed between the three stringers 22. This construction enables pallet 21 to be raised and lowered from any of its four sides.

As fully detailed above, one of the principal problems incurred by this conventional pallet construction is the ease with which stringers 22 are damaged when the tines of the forklift truck directly contact the terminating edges or ends of a stringer 22. This unwanted contact, which typically occurs when the forklift truck is under power, causes the leading edge of the tines to be driven into the stringers, resulting in the terminating end of stringer 22 being broken, damaged, or split. Once damaged in this way, the pallet often loses structural integrity, requiring the pallet to be repaired, if possible, or replaced. Damage of this nature is widely prevalent in industries employing pallets and, prior to the present invention, has been incapable of being adequately circumvented. By employing the stringer end capping/protecting system 20 of the present invention, this prior art problem is eliminated.

As shown in FIGS. 1–11, stringer end capping/protecting system 20 of the present invention comprises reinforcing plate 30 and bracket member 31. In the preferred construction, bracket member 31 comprises an elongated, substantially flat, flexible plate which is easily formed into a substantially U-shape incorporating a central or intermediate zone 32 and two juxtaposed, spaced, side portions 33—33 interconnected with and extending from opposed edges of central zone 32.

In order to provide pallet 21 with the desired protection achieved by the present invention, stringer end capping/protecting system 20 is securely affixed to each terminating end 25 of each stinger 22. The secure mounted engagement of stringer end capping/protecting system 20 with stringer 22 is achieved by affixing each side 33 of each bracket member 31 of each protecting system 20 directly to a portion of the side of each stringer 22 adjacent its terminating end 25. As depicted in FIGS. 1 and 2, this is most easily achieved by employing nails 34 which are driven through each side 33 of each bracket member 31 securely affixing side 33 to stringer 22. Although nails 34 are preferred for ease, simplicity, and availability, other fastening means, such as staples, rivets, etc., may be employed with equal efficacy.

Figure 4:
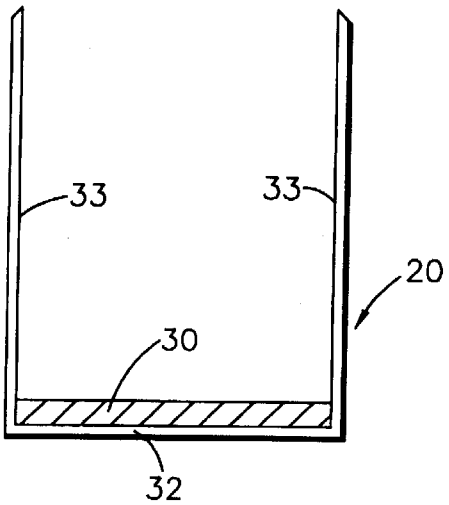
FIG. 4 is a top plan view of the stringer end capping/protecting system of FIG. 3.
Figure 3:
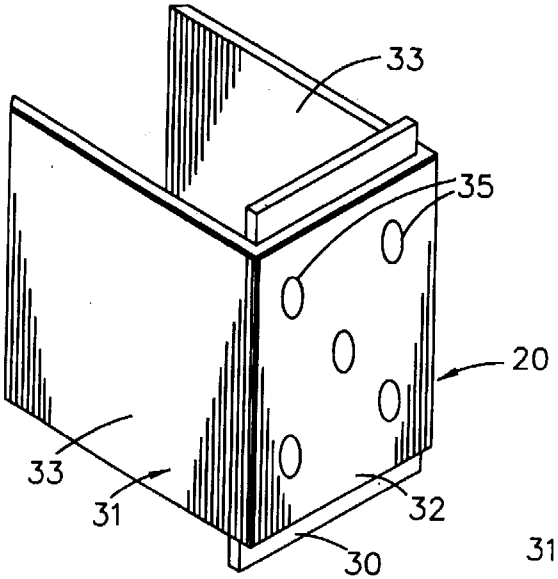
FIG. 3 is a perspective view of one embodiment of the stringer end capping/protecting system of the present invention depicted ready for mounting to a stringer.
Figure 5:
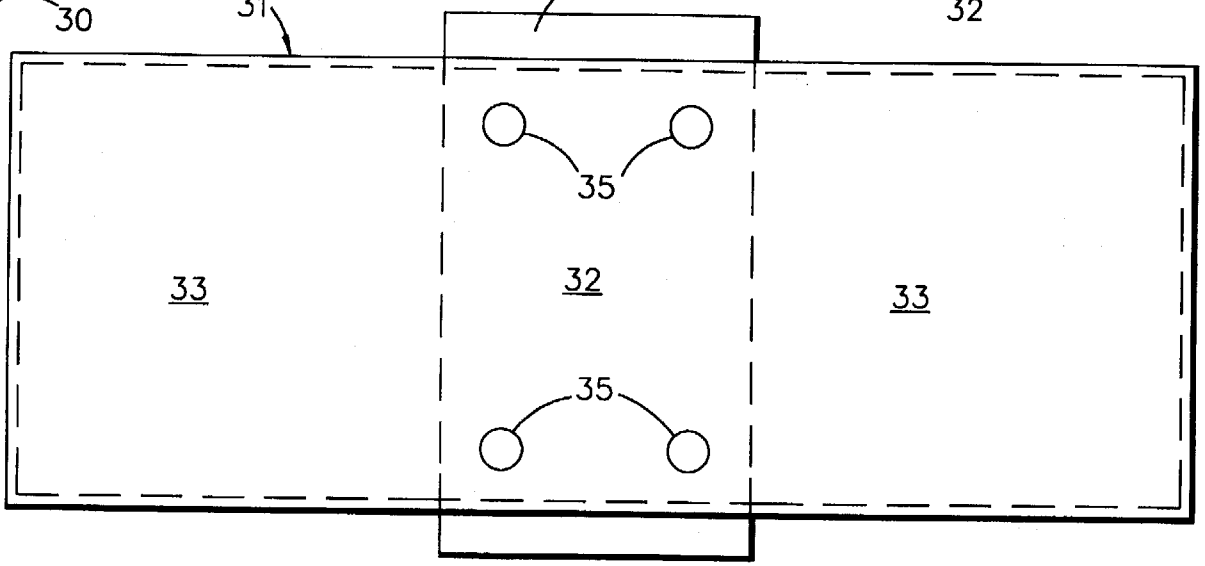
FIG. 5 is an unassembled, flat, planar view of the stringer end capping/protecting system of FIG. 3 depicted prior to the formation of the U-shaped bracket member.

In FIGS. 3, 4, and 5, the embodiment of stringer end capping/protecting system 20 depicted in FIGS. 1 and 2 is shown in greater detail. As shown in these figures, bracket member 31 is preferably formed as an elongated, substantially flat sheet of thin walled material which is formed into the desired U-shape during the installation process. However, if desired, the material forming bracket member 31 can be preformed in a U-shape, as depicted in FIGS. 3 and 4, prior to installation.

Regardless of whether bracket member 31 is formed as a substantially flat, planar sheet of material, as shown in FIG. 5, or is preformed into its U-shape, as depicted in FIGS. 3 and 4, the preferred construction of the present invention positions reinforcing plate 30 substantially mid-way along the length of bracket member 31, where reinforcing plate 30 is securely mounted in this desired position by affixation means, such as spot welding. As shown in FIGS. 3 and 5, a plurality of weld points 35 are shown, depicting the secure affixation of reinforcing plate 30 to bracket member 31. If desired, any alternate fastening means can be employed to secure reinforcing plate 30 to bracket member 31.

In constructing stringer end capping/protecting system 20, in accordance with the present invention, any desired material can be employed for constructing bracket member 31. In general, as long as the principal requirements of flexibility and holding strength for positioning and maintaining reinforcing plate 30 in the desired location are met, bracket member 31 can be formed from any convenient, accessible material.

In the preferred construction, any type of sheet metal is employed for bracket member 31. Preferably, 22 gauge sheet metal is employed and is formed in a generally elongated rectangular shape, as depicted in FIG. 5, with a width substantially equal to the width of terminating end 25 of stringer 22. However, other materials and other thicknesses can be employed with equal efficacy.

In order to assure continuous, long-term operation without unwanted interference with the tines of the forklift truck, bracket member 31 is also preferably constructed with each terminating edge thereof being chamfered, beveled, rolled, or tapered. In this way, the transition from bracket member 31 to the side of stringer 22 is achieved gradually, eliminating any raised edges which may cause interference with the movement of the tines of the forklift truck or with any of the operations being conducted in or about pallet 21.

The principal component of stringer end capping/protecting system 20 is reinforcing plate 30, which is positioned in overlying, protecting relationship with terminating end 25 of each stringer 22. By constructing reinforcing plate 30 from material which is capable of absorbing and/or dissipating the force imposed thereon, whenever the tines of a forklift truck come in contact therewith, stringer 22 is protected. As is apparent to one of ordinary skill in the art, numerous alternate materials and compositions, such as metals, plastics and the like, can be employed with equal efficacy.

Although any desired material can be employed for reinforcing plate 30, it has been found that a highly effective reinforcing plate 30 is achieved by employing rolled steel or stainless steel. In addition, reinforcing plate 30 preferably comprises a width substantially equal to the width of end 25 of stringer 22. In this way, reinforcing plate 30 covers substantially the entire width of end 25 of stringer 22.

Another important factor in constructing reinforcing plate 30 is the thickness of the material being employed. Although the thickness depends upon the material itself, its strength, and rigidity, it has been found that when rolled steel or stainless steel is employed, reinforcing plate 30 preferably comprises a thickness ranging between about 1/16 and 5/16 inches. Although this range has been found to be highly effective, the preferred construction is achieved with a thickness ranging between about 1/8 and 3/16 inches.

As is readily apparent to one of ordinary skill in the art, the thickness of reinforcing plate 30 is specifically dependent upon the material employed for reinforcing plate 30. As a result, the structure detailed above can be widely varied, without departing from the scope of the present invention. As is evident from the teaching provided herein, reinforcing plate 30 may be constructed of any desired material with any desired thickness, size, and shape, as long as terminating end 25 of each stringer 22 is covered in its substantial entirety and protected by a reinforcing plate 30 which is capable of receiving the forces generated by contact with the tines of a forklift truck and absorb and dissipate the force without transferring the force to stringer 22 in the form of structural damage. As long as these conditions are satisfied, an effective reinforcing plate 30 is achieved.

In FIG. 3–11, three alternate embodiments for reinforcing plate 30 are depicted. In each of these embodiments, reinforcing plate 30 is constructed in a substantially identical manner with the sole variation between these embodiments being the overall length of reinforcing plate 30. Although it is preferred for reinforcing plate 30 to cover substantially the entire surface area of each end 25 of each stringer 22, it has also been found that reinforcing plate 30 is effectively constructed with an overall length greater than the length of end 25 of stringer 22. By extending reinforcing plate 30 beyond the length of end 25 of stringer 22, protection is also imparted to plank members 23 in the vulnerable area where plank members 23 are affixed to stringer 22 directly adjacent terminating end 25 of stringer 22.

In the embodiment depicted in FIGS. 3–5, reinforcing plate 30 extends beyond the overall width of bracket member 31, as well as the length of terminating end 25 of each stringer 22 in two opposite directions. In FIGS. 3–5, this extension is depicted as being in an upward and downward direction. This embodiment is consistent with the embodiment of reinforcing plate 30 depicted in FIGS. 1 and 2.

As is evident from these figures, this embodiment of reinforcing plate 30 is constructed with an overall length which overlies terminating end 25 of stringer 22 as well as the side edge of plank member 23 affixed to the top edge of stringer 22 and plank member 23 affixed to the bottom edge of stringer 22. By employing this construction, stringer 22 is protected in its entirety, while the vulnerable edges of plank members 23, affixed to stringers 22, are also protected. Since the edges of plank member 23, affixed to stringer 22, are exposed to contact and breakage by the tines of the forklift truck, protection of this area is desirable. By employing this embodiment of the present invention, it has been found that optimum protection is provided to pallet 21, reducing damage to stringers 22 as well as to the plank members 23 which define the outer peripheral, terminating edges of pallet 21.

Figure 7:
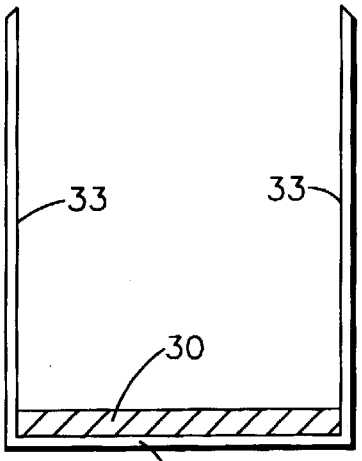
FIG. 7 is a top plan view of the stringer end capping/protecting system of FIG. 6.
Figure 6:
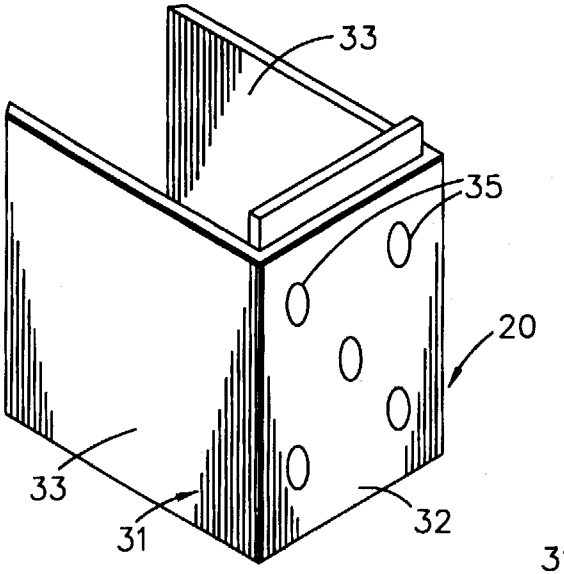
FIG. 6 is a perspective view of an alternate embodiment of the stringer end capping/protecting system of the present invention.
Figure 8:
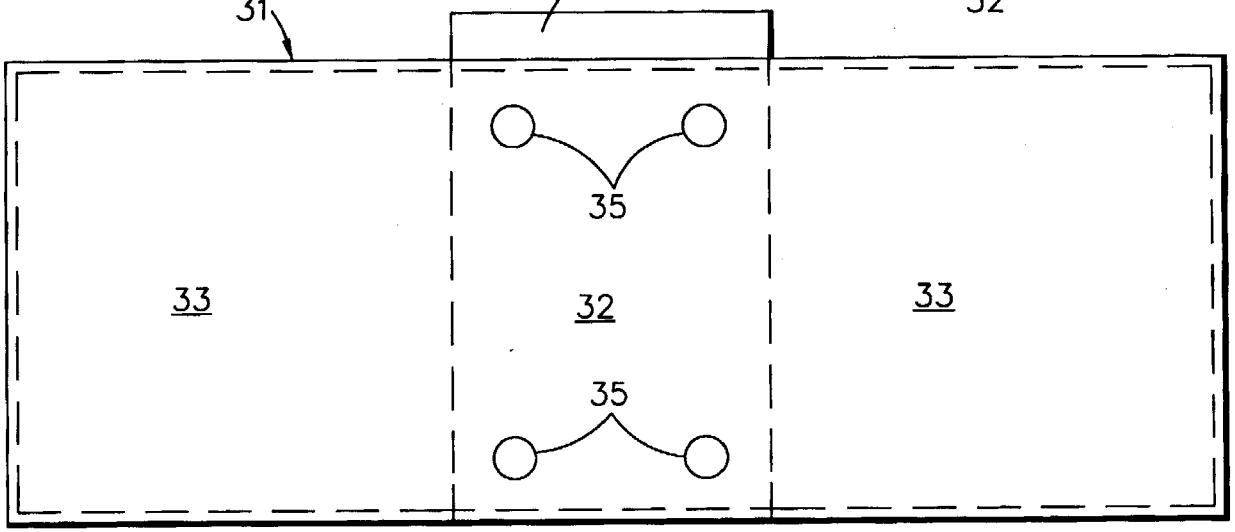
FIG. 8 is an unassembled, flat, planar view of the stringer end capping/protecting system of FIG. 6 depicted prior to the formation of the U-shaped bracket member.

In FIGS. 6–8, an alternate embodiment of stringer end capping/ protecting system 20 of the present invention is depicted. In this embodiment, reinforcing plate 30 comprises a length which extends beyond the width of bracket member 31 in only one direction, as opposed to the two directions depicted in FIGS. 3–5. By employing this embodiment, reinforcing plate 30 completely covers the entire terminating end 25 of stringer 22 as well as the side edge of one of the plank members 23 affixed to stringer 22. If the top plank member is to be protected, bracket member 31 is installed with the extension of reinforcing plate 30 extending upwardly. Similarly, if the bottom plank member is to be protected, bracket member 31 is mounted to stringer 22 with the extension of reinforcing plate 30 protruding in a downward direction.

By employing this embodiment, either top plank member 23 or bottom plank member 23 of pallet 21 is protected at each position where the plank member is affixed to stringer 22 adjacent its terminating edge. In this way, the plank member 23 which is considered by the user to be the most vulnerable is protected, along with stringer 22.

Figure 10:
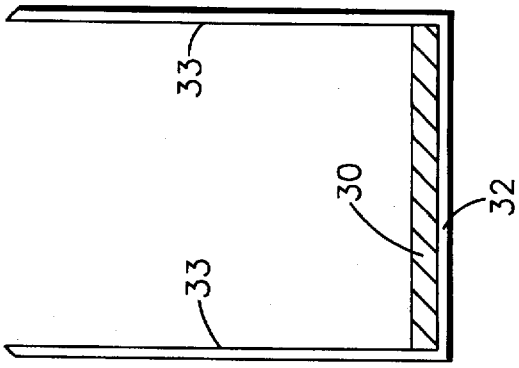
FIG. 10 is a top plan view of the stringer end capping/protecting system of FIG. 9.
Figure 9:
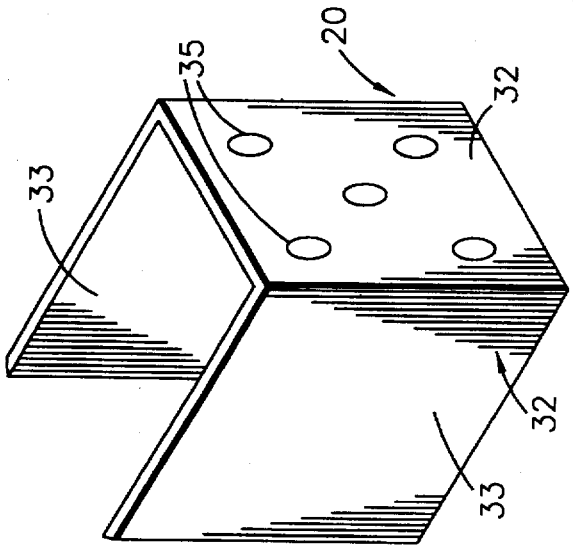
FIG. 9 is a perspective view of a still further alternate embodiment of the stringer end capping/protecting system of the present invention.
Figure 11:
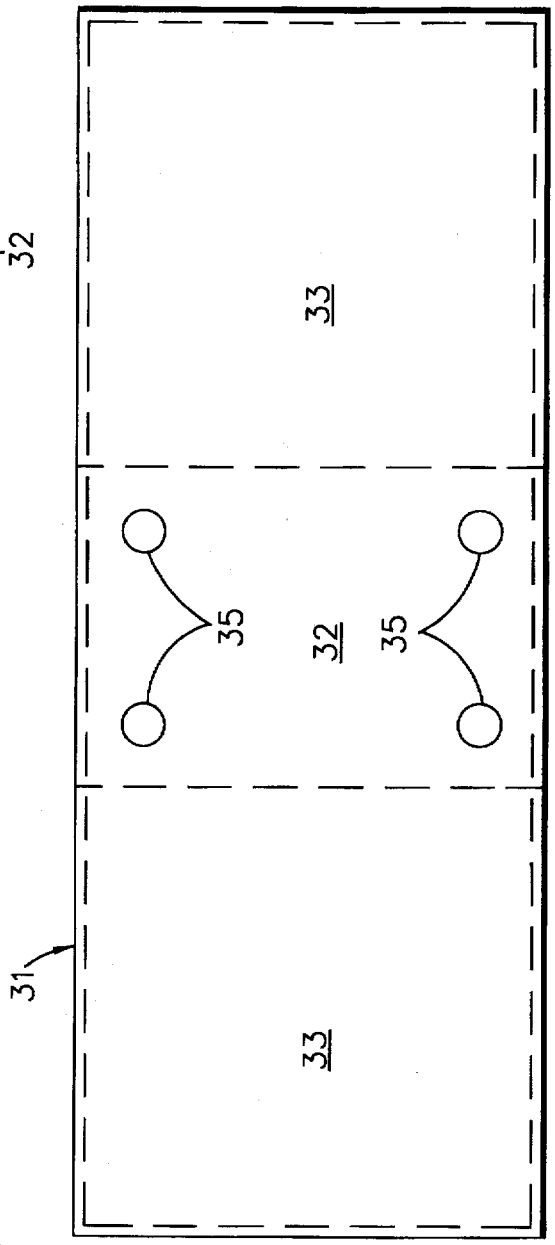
FIG. 11 is an unassembled, flat, planar view of the stringer end capping/protecting system of FIG. 9 depicted prior to the formation of the U-shaped bracket member.

Finally, FIGS. 9–11 depict the third alternate embodiment of the present invention. In this embodiment, stringer end capping/protecting system 20 incorporates reinforcing plate 30 which comprises an overall length substantially equal to the length of terminating end 25 of stringer 22. By employing this embodiment, terminating end 25 of stringer 22 is fully protected, while neither the upper or lower plank members 23 are protected. Regardless of which embodiment of the present invention is employed, each stringer 22 is fully protected by stringer end capping/protecting system 20 of the present invention, preventing stringer 22 from incurring any damage by contact with the tines of a forklift truck.

The selection of the particular embodiment of the present invention to employ on any particular pallet construction is completely at the discretion of the user. In some instances, users have consistently avoided protection of the plank member due to a belief that covering the plank member will cause pallet repair to be more difficult. In the present invention, it has been found that this difficulty does not occur and any plank member 23 can be quickly and easily removed and replaced regardless of the configuration of reinforcing plate 30 employed in stringer end capping/ protecting system 20. However, in order to accommodate the various unique desires and requirements of various users, the three alternate constructions for reinforcing plate 30 are available.

As is apparent from the foregoing detailed disclosure, the incorporation of stringer end capping/protecting system 20 about the terminating ends 25 of each stringer 22 imparts, to the overall pallet construction, a level of protection heretofore unattainable. Once stringer end capping/protecting system 20 is securely affixed in the desired position, each stringer is independent protected against contact with the leading edge of the tines of the forklift truck, which have heretofore caused the stringers to be damaged or destroyed. However, by incorporating stringer end capping/protecting system 20, this damage or destruction is completely eliminated and pallet longevity is attained, virtually eliminating repair problems.

It will thus be seen that the objects set forth above, among those made apparent from the preceding description are efficiently attained and, since certain changes may be made in the above article without departing from the scope of the invention, it is intended that all matter contained in above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim is new and desire to secure by Letters Patent is:

1. In a pallet construction comprising a plurality of substantially equal length, longitudinally-extending stringers mounted in juxtaposed, spaced, parallel relationship to each other with each of said stringers comprising opposed terminating ends having a height dimension and a width dimension and a plurality of substantially equal length longitudinally extending plank members mounted in juxtaposed, spaced, parallel relationship to each other, each extending longitudinally in a direction substantially perpendicular to the longitudinal direction of the stringers and each of said plank members being fastened to said stringers, the improvement comprising a protecting system easily mountable to any desired stringer end, said protecting system comprising A. a first reinforcing plate securely affixable to one of said ends of one stringer and comprising dimensions for overlying a substantial portion of the stringer end, protecting the stringer from damage; B. holding means; a. cooperatively associated in overlying engagement with the reinforcing plate, b. covering a substantial portion of the reinforcing plate, and c. securely maintaining the reinforcing plate on the stringer end in the desired protecting position; and C. fastening means mounted to the holding means for affixing the holding means and the reinforcing plate retained therewith to the stringer.

2. The pallet protection system defined in claim 1, wherein said reinforcing plate is further defined as comprising a substantially rectangular shape.

3. The pallet protection system defined in claim 2, wherein said reinforcing plate is further defined as being formed from material selected from the group consisting of rolled steel, stainless steel, and plastics.

4. The pallet protection system defined in claim 1, wherein said reinforcing plate is further defined as comprising a thickness ranging between about 1/16 and 5/16 inches.

5. The pallet protection system defined in claim 4, wherein the reinforcing plate is further defined as comprising a width substantially equivalent to the width of the terminating end of the stringer.

6. The pallet protection system defined in claim 1, wherein said reinforcing plate is further defined as comprising a length substantially equivalent to the length of the terminating end of the stringer to which the reinforcing plate is secured.

7. The pallet protection system defined in claim 1, wherein said reinforcing plate is further defined as comprising a length which is substantially equivalent to the combined length of the terminating end of the stringer to which the reinforcing plate is affixed and the thickness of at least one plank member mounted thereto.

8. The pallet protection system defined in claim 7, wherein the pallet is further defined as comprising a second plurality of substantially equal length longitudinally extending plank members, with each plank member being positioned in juxtaposed, spaced, parallel relationship to one plank member of the first plurality of plank members and securely fastened to said stringers and the reinforcing plate is further defined as comprising an overall length substantially equivalent to the length of the end of the stringer to which the reinforcing plate is affixed and the thickness of both plank members affixed to the stringer.

9. The pallet protection system defined in claim 1 wherein said holding means is further defined as comprising an elongated strip constructed for being mounted to the end of the stringer with the reinforcing plate sandwiched between the strip and the terminating end of the stringer, with a portion of said strip being securely affixed to the stringer, thereby securely retaining the reinforcing plate in the precisely desired position in juxtaposed, contacting, overlying relationship with the terminating end of the stringer.

10. The pallet protection system defined in claim 9, wherein said elongated strip is further defined as being formed from metal in a generally U-shape, with the reinforcing plate retained along the central portion thereof, and the sides of said U-shaped member being securely affixed to the sides of the stringer.

11. The pallet protection system defined in claim 10, wherein said reinforcing plate is further defined as being securely affixed to said U-shaped, metal holding means, thereby preventing unwanted slippage or movement of the reinforcing plate relative to the holding means.

12. The pallet protection system defined in claim 11, wherein said reinforcing plate is affixed to the holding means by welding.

13. The pallet protection system defined in claim 10, wherein said fastening means is further defined as comprising nails and the holding means is securely affixed to the sides of the stringer by driving the nails through the sides of the U-shaped metal holding means into the sides of the stringer.

14. The pallet protection system defined in claim 10, wherein said U-shaped, holding means is further defined as comprising a width substantially equivalent to the overall length of the terminating end of the stringer to which said holding means is affixed.

15. The pallet protection system defined in claim 9, wherein said holding means is further defined as being formed from an elongated metal strip having sufficient flexibility to be easily formed into a generally U-shape for peripherally surrounding the reinforcing plate and securely maintaining the reinforcing plate in the desired position.

16. The protecting system defined in claim 11, further comprising a plurality of reinforcing plates, holding means, and fastening means, each being separately mounted to independent ends of said stringers for protecting each of said stringer ends.

* * * * *